US009858858B2

(12) United States Patent
Seo et al.

(10) Patent No.: US 9,858,858 B2
(45) Date of Patent: Jan. 2, 2018

(54) ACTIVE MATRIX LED PIXEL DRIVING CIRCUIT AND LAYOUT METHOD

(71) Applicant: Kopin Corporation, Westborough, MA (US)

(72) Inventors: Yong Seok Seo, Palo Alto, CA (US); Jin Kuk Kim, San Jose, CA (US); Seung Youb Kim, Fremont, CA (US); Jang Ho Kim, San Jose, CA (US)

(73) Assignee: Kopin Corporation, Westborough, MA (US)

( * ) Notice: Subject to any disclaimer, the term of this patent is extended or adjusted under 35 U.S.C. 154(b) by 141 days.

(21) Appl. No.: 14/824,244

(22) Filed: Aug. 12, 2015

(65) Prior Publication Data

US 2016/0086534 A1 Mar. 24, 2016

Related U.S. Application Data

(60) Provisional application No. 62/052,720, filed on Sep. 19, 2014.

(51) Int. Cl.
*G09G 3/30* (2006.01)
*G09G 3/3233* (2016.01)

(52) U.S. Cl.
CPC ... *G09G 3/3233* (2013.01); *G09G 2300/0819* (2013.01); *G09G 2300/0852* (2013.01); *G09G 2300/0861* (2013.01); *G09G 2310/0262* (2013.01); *G09G 2320/0233* (2013.01); *G09G 2320/043* (2013.01)

(58) Field of Classification Search
CPC .. G09G 3/3208; G09G 3/3225; G09G 3/3233; G09G 2300/0439
See application file for complete search history.

(56) References Cited

U.S. PATENT DOCUMENTS 6,228,696 B1 5/2001 Nguyen et al.
8,400,746 B1 * 3/2013 Keramat ..... H01L 27/0207 361/111
2007/0001945 A1 1/2007 Yoshida
2007/0200802 A1 8/2007 Kasai
2011/0227081 A1 * 9/2011 Matsuda ..... H01L 27/12 257/59

FOREIGN PATENT DOCUMENTS

WO WO 2016/043873 3/2016

OTHER PUBLICATIONS

International Search Report and Written Opinion for PCT/US2015/044796 dated Nov. 5, 2015 entitled "Active Matrix LED Pixel Driving Circuit and Layout Method".
International Preliminary Report on Patentability for PCT/US2015/044796 dated Mar. 30, 2017 entitled "Active Matrix LED Pixel Driving Circuit and Layout Method".

* cited by examiner

*Primary Examiner* — Dennis Joseph
(74) *Attorney, Agent, or Firm* — Hamilton, Brook, Smith & Reynolds, P.C.

(57) ABSTRACT

A unit pixel driver circuit includes a capacitor configured to store a voltage corresponding to a desired pixel brightness and a control block. The control block may include a first, second third and fourth transistors, all of which are connected together, both in parallel and in series. The control block controls, based on the voltage stored in the capacitor, the amount of current flowing through a pixel LED. The first transistor, second transistor, third transistor and fourth transistor all share a common gate geometry size.

8 Claims, 3 Drawing Sheets

ACTIVE MATRIX LED PIXEL DRIVING CIRCUIT AND LAYOUT METHOD

RELATED APPLICATION(S)

This application claims the benefit of U.S. Provisional Application No. 62/052,720, filed on Sep. 19, 2014. This application is related to U.S. application Ser. No. 14/732,058, filed on Jun. 5, 2015. The entire teachings of the above applications are incorporated herein by reference.

BACKGROUND OF THE INVENTION

Mobile computing devices, such as notebook PCs, smart phones, and tablet computing devices, are now common tools used for producing, analyzing, communicating, and consuming data in both business and personal life. Consumers continue to embrace a mobile digital lifestyle as the ease of access to digital information increases with high-speed wireless communications technologies becoming ubiquitous. Popular uses of mobile computing devices include displaying large amounts of high-resolution computer graphics information and video content, often wirelessly streamed to the device.

While these devices typically include a display screen, the preferred visual experience of a high-resolution, large format display cannot be easily replicated in such mobile devices because the physical size of such device is limited to promote mobility. Another drawback of the aforementioned device types is that the user interface is hands-dependent, typically requiring a user to enter data or make selections using a keyboard (physical or virtual) or touch-screen display.

As a result, consumers are now seeking a hands-free high-quality, portable, color display solution to augment or replace their hands-dependent mobile devices.

One example of such a display solution is the active matrix light emitting diode (LED) display. The active matrix LED display uses a storage capacitor, for each pixel, that is charged by a driving voltage during a display scan period. The capacitor stores the voltage until the next scan frame, at which time the capacitor stores a new voltage corresponding to that scan frame. The stored voltage provides a reference to the pixel circuit for driving current to LED during the one frame time—the amount of current driven depends on the value of the stored voltage.

For the example active matrix LED display shown in FIG. 1, each unit pixel consists of transistors 1, 2 and 4, a capacitor 3, and an LED 5. The gate of the transistor 1 receives a select signal through a Select Line (SL) while its source receives a voltage data signal through a VData line. The voltage data signal is transmitted to the gate of the transistor 2 when the transistor 1 is turned on by the select signal and the voltage level of the data signal VData turns on the transistor 2 to generate a driving current through the transistor 2 lighting the LED 5 during the transistor 4 turn on time.

A disadvantage of the circuit depicted in the example of FIG. 1 is that the output of the LED driving circuit (i.e., the LED driving current) may be sensitive to circuit parameter variations. Such parameter variations may include, for example, variations of the transistors' threshold voltages, and variations in the widths and lengths of the transistor physical gate geometries. The differences between the driving currents from pixel to pixel may lead to non-uniform illumination on the active matrix LED display.

SUMMARY OF THE INVENTION

The described embodiments provide a circuit for controlling a pixel-driving current. The circuit reduces and/or mitigates the effects of process variations inherent in the manufacturing processes used to produce such driving circuits. The described embodiments accomplish the reduction and/or mitigation by forming a current control block that consists of a combination of transistors connected in both parallel and serial. The described embodiments also maintain a common gate geometry size across many or all of the transistors in the current controlling circuit.

In one aspect, the invention may be a unit pixel driver circuit that includes a capacitor configured to store a voltage corresponding to a desired pixel brightness, a control block having two or more transistors connected together in parallel and in series. The control block may be configured to control an amount of current flowing through a pixel LED corresponding to the voltage stored in the capacitor. The two or more transistors of the control block configured to share a common gate geometry size.

In one embodiment, the control block may further include a first transistor, a second transistor, a third transistor, and a fourth transistor. All four transistors may be connected together both in parallel and in series. The gates of the first transistor, the second transistor, the third transistor and the fourth transistor may be electrically coupled to one another to form a first node. The drains of the first transistor and the second transistor may be electrically coupled to one another to form a second node. The sources of the first transistor and the second transistor, and the drains of the third transistor and the fourth transistor may be electrically coupled to one another to form a third node. The sources of the third transistor and the fourth transistor may be electrically coupled to one another.

In one embodiment, the unit pixel driver circuit may further include a data transistor. The source of the data transistor may be electrically coupled to a data signal line, the drain of the data transistor may be electrically coupled to the first node, and the gate of the data transistor may be electrically coupled to a select line configured to convey a select signal.

In another embodiment, the unit pixel driver may further include a gating transistor. The source of the gating transistor may be electrically coupled to a reference voltage, the drain of the gating transistor may be electrically coupled to the fourth node, and the gate of the gating transistor may be electrically coupled to an enable line configured to convey an enable signal.

In another embodiment, the transistors are disposed on a substrate such that the first transistor is adjacent to the second transistor and the third transistor, the second transistor is adjacent to the first transistor and the fourth transistor, the third transistor is adjacent to the first transistor and the fourth transistor, and the fourth transistor is adjacent to the second transistor and the third transistor.

One embodiment further includes a data transistor and a gating transistor. The gating transistor and a data transistor may be disposed on the substrate such that the data transistor is adjacent to the first transistor and the gating transistor, and the gating transistor is adjacent to the second transistor and the data transistor.

In one embodiment, the first transistor, the second transistor, the third transistor, the fourth transistor, the data transistor and the gating transistor form a transistor group, and the capacitor is distributed about a perimeter of the transistor group.

In another embodiment, the capacitor is implemented using one or more transistors. The one or more transistors that implement the capacitor may share a common gate geometry size with the two or more transistors of the control block.

In another aspect, the invention may be a unit pixel driver circuit that includes two or more transistors connected together in parallel and in series. The two or more transistors may be configured to control an amount of current flowing through a pixel LED corresponding to a signal applied to gates of the two or more transistors. The two or more transistors may be distributed on a substrate in a uniform pattern, the two or more transistors configured to share a common gate geometry size. In one embodiment, the uniform pattern is a set of rows and columns.

In another aspect, the invention may be a method of driving a pixel LED, comprising applying a control signal to a block of two or more transistors connected together in parallel and in series, and configured to share a common gate geometry size. The method may further include controlling an amount of current flowing through the pixel LED, the amount of current corresponding to the control signal.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

Figure 2:
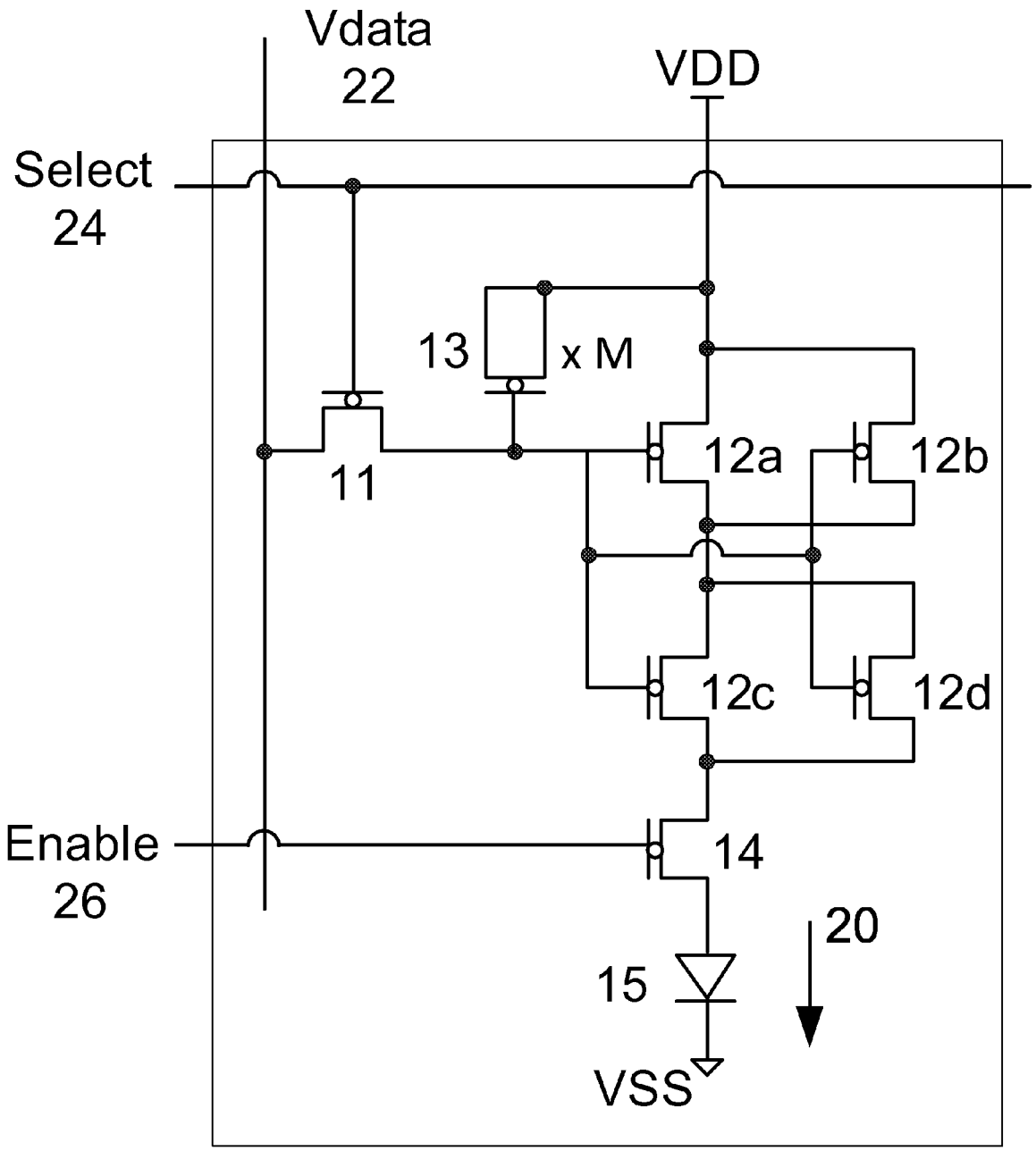
FIG. 2 shows an example active matrix LED display according to an embodiment of the invention.

The FIG. 2 is a unit pixel circuit configured according to an embodiment of the invention.

The unit pixel circuit of FIG. 2 includes six transistors 12*a*, 12*b*, 12*c*, 12*d*, 11 and 14*a*, a capacitor 13, and an LED 15. Although the example embodiments describe driving an LED within the pixel circuit, the concepts described may be used for other pixel elements for providing a visual display aspect.

The capacitor 13 may be implemented by a transistor constructed and arranged in a particular way, as described in more detail below. The capacitor 13 may be implemented using alternative techniques known in the art, for example using oxide as the capacitor dielectric and either metal or heavily doped silicon as the capacitor plates. In FIG. 2, the capacitor 13 includes a designation of "x M," meaning that the capacitor 13 may actually consist of M transistors, where M is an integer.

Figure 1:
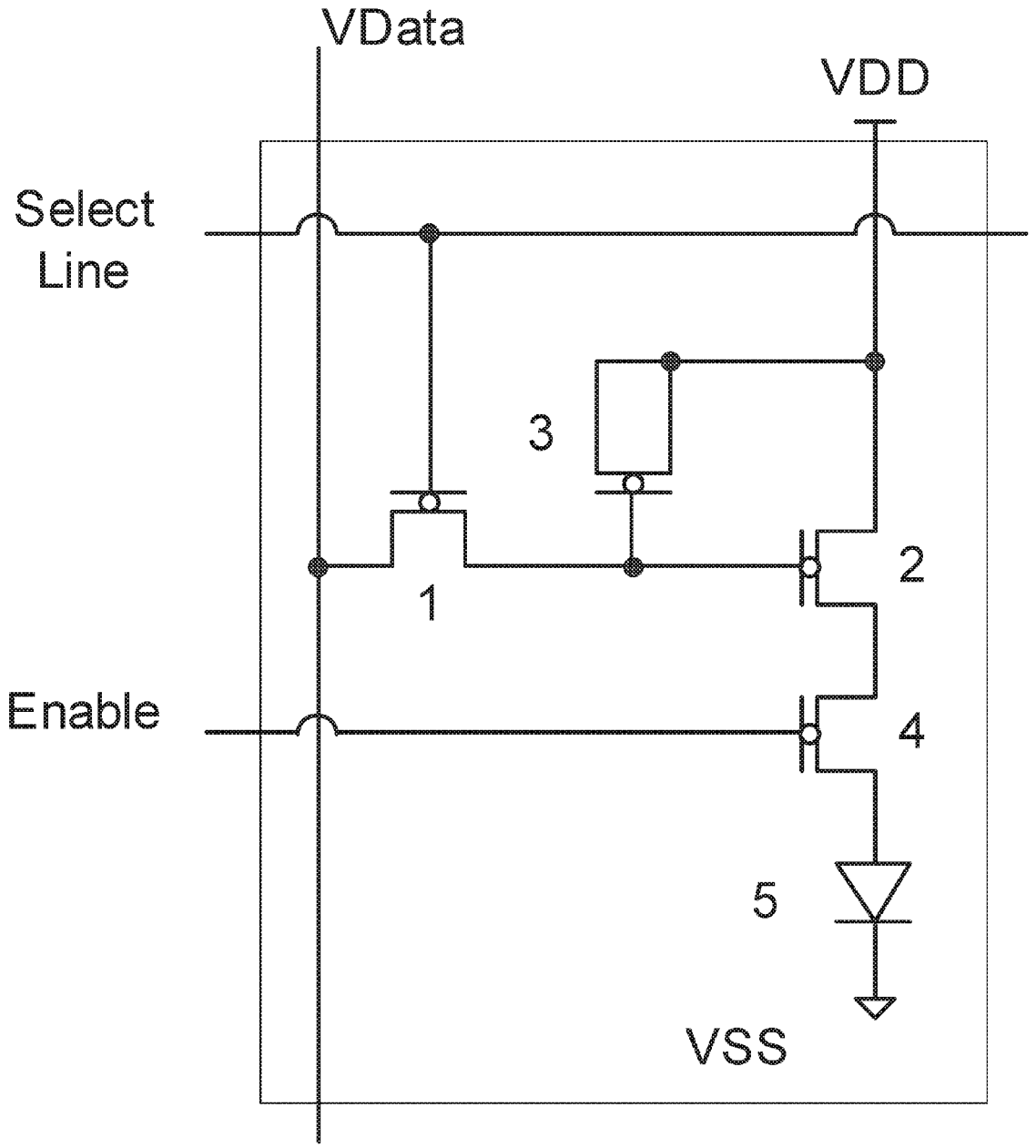
(Prior art) FIG. 1
FIG. 1 shows an example prior-art active matrix LED display.

Transistors 12*a*, 12*b*, 12*c* and 12*d* in FIG. 2 provide a function that is similar to the function performed by transistor 2 in FIG. 1. Together, transistors 12*a*, 12*b*, 12*c* and 12*d* form a control block that controls the LED drive current 20 supplied to LED 15. The amount of LED drive current 20 depends on the value of the voltage stored in storage capacitor 13 (or storage capacitor 3 in the circuit shown in FIG. 1).

Transistor 11 is referred to herein as a data transistor. The data transistor 11 conveys a data signal from VData line 22 to the gates of transistors 12*a*, 12*b*, 12*c* and 12*d*, and to capacitor 13, when the data transistor 11 is turned on. The data transistor 11 is turned on based on an Select signal applied from Select line 24. As used herein, the term "line," as in "VData line 22," may refer to any physical medium capable of conveying a signal, such as an electrical conductor (e.g., wire, coaxial cable, printed circuit board trace), optical fiber, waveguide, microstrip, or strip line, among others.

Transistor 14 is referred to herein as a gateway transistor. The gateway transistor 14 controls the LED drive current 20, based on an Enable signal applied to the gateway transistor's gate via the Enable line 26. In other words, transistor 14 gates the LED drive current 20, according to the enable signal conveyed via the Enable line 26.

Transistors 12*a*, 12*b*, 12*c* and 12*d* are connected as shown, both with parallel connection aspects and series connection aspects. The gates of all transistors 12*a*, 12*b*, 12*c* and 12*d* are all electrically coupled together, and to the drain of transistor 11, to form a first node. The drains of transistors 12*a* and 12*b* are electrically coupled together and to reference voltage VDD, to form a second node. The sources of transistors 12*a* and 12*b* are electrically coupled to one another and also to the drains of transistors 12*c* and 12*d*. The sources of transistors 12*c* and 12*d* are electrically coupled one another and also to the drain of transistor 14. Thus, the transistor pairs [12*a*, 12*b*] and [12*c*, 12*d*] are connected in parallel, while the transistor pairs [12*a*, 12*c*] and [12*b*, 12*d*] are connected in series.

In the example embodiment shown in FIG. 2, transistors 12*a*, 12*b*, 12*c* and 12*d* are all disposed on a substrate (e.g., a semiconductor substrate) with the transistors having substantially the same width and length of gate geometry. In other embodiments, all transistors 12*a*, 12*b*, 12*c*, 12*d*, 11 and 14*a* in the unit pixel circuit are disposed with substantially the same width and length size gate geometry. This common width and length size may serve to reduce and/or mitigate the effects of process variations, since any process variations may produce a similar effect on elements having similar width and length characteristics.

Figure 3:
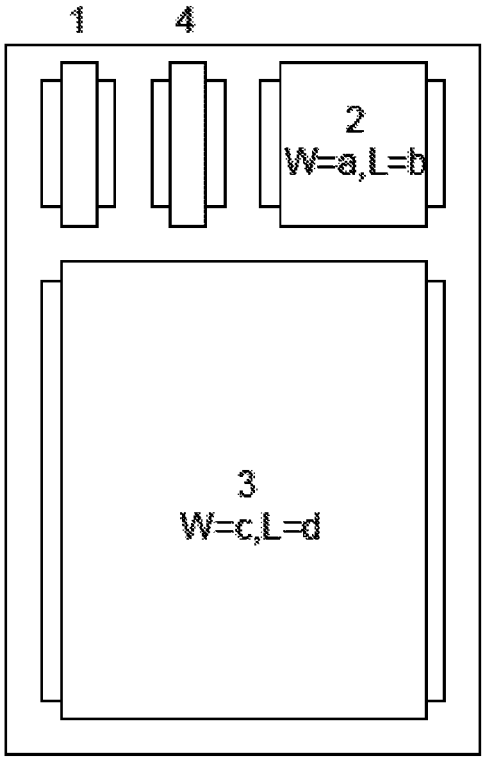
(Prior art) FIG. 3
FIG. 3 shows example gate geometries corresponding to the display circuit shown in FIG. 1.

FIG. 3 illustrates gate geometries of the transistors for the example prior art circuit shown in FIG. 1. As shown, transistors 1 and 4 share a common gate geometry size (i.e., W=a, L=b), while the gate geometry size of transistors 2 (W=c, L=d) and 3 (W=e, L=f; not shown) are substantially different from one another, and also from transistors 1 and 4.

Figure 4:
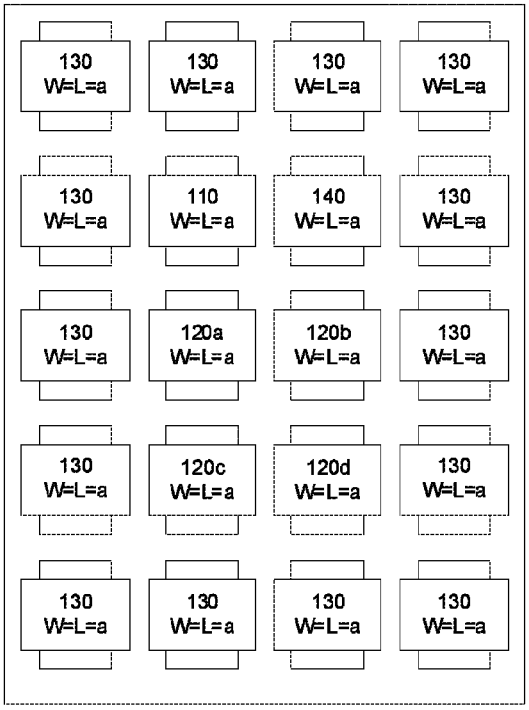
FIG. 4 shows example gate geometries according to one embodiment of the invention, corresponding to the display circuit shown in FIG. 2.

FIG. 4 illustrates gate geometries of the transistors for the example unit pixel circuit shown in FIG. 2. In this example embodiment, the gate geometries 110, 120*a*, 120*b*, 120*c*, 120*d*, 130 and 140 (corresponding to transistors 11, 12*a*, 12*b*, 12*c*, 12*d*, 13 and 14, respectively), are substantially the same, i.e., width=length=a, where "a" is a value quantifying a distance along a linear dimension. Examples of such values may be 25 nm or 6.0 μm (it should be noted that these are merely examples of possible values to illustrate the nature of the value. These specific values are not meant to limit the invention in any way).

In the example embodiment of FIG. 4, the transistors are distributed in a uniform pattern, in this example a grid formation of rows and columns. Other distribution patterns may be used in alternative embodiments. For example, the distribution could be in concentric circles, a hexagonal honeycomb pattern, or in a set of parallel diagonals.

The transistor 110 is arranged adjacent to 140, and the transistors 120*a*, 120*b*, 120*c* and 120*d* are arranged adjacent to one another as shown. The transistors 130, at least some of which collectively form the storage capacitor 13, are arranged in the described embodiment along a perimeter surrounding the remaining transistors 110, 140, 120*a*, 120*b*, 120*c* and 120*d*.

In some embodiments, the transistors 130 may each be configured to exhibit a capacitance of a particular value. Techniques for so configuring the transistors 130 are well known in the art. For example, the gate-to-channel capacitance may be accessed so as to provide the specific capacitance, or the gate-to-bulk capacitance may be used. In some embodiments, the configuration and parameters associated with the transistor 130 may be set to place the transistor 130 in accumulation mode; in other embodiments the transistor may be set up in inversion mode.

The design of the unit pixel circuit shown in FIG. 2 may require a storage capacitor 13 with a specific capacitance value. In some embodiments, that specific capacitance may be implemented by a selective combination of the transistors 130. In some embodiments, two or more of the transistors 130 may be electrically connected and arranged in a serial or parallel configuration, so that the combined capacitance results in a desired, specific, value.

While this invention has been particularly shown and described with references to example embodiments thereof, it will be understood by those skilled in the art that various changes in form and details may be made therein without departing from the scope of the invention encompassed by the appended claims.

What is claimed is:

1. A unit pixel driver circuit, comprising:

a capacitor configured to store a voltage corresponding to a desired pixel brightness, the capacitor comprising an interconnected combination of constituent transistors;

a first transistor comprising a first transistor gate, a first transistor drain and a first transistor source;

a second transistor comprising a second transistor gate, a second transistor drain and a second transistor source;

a third transistor comprising a third transistor gate, a third transistor drain and a third transistor source;

a fourth transistor comprising a fourth transistor gate, a fourth transistor drain and a fourth transistor source, the first, second, third and fourth transistors are configured such that:

(i) the first transistor drain is electrically coupled directly to the second transistor drain;

(ii) the first transistor source is electrically coupled directly to a second transistor source;

(iii) the third transistor drain is electrically coupled directly to the fourth transistor drain;

(iv) the third transistor source is electrically coupled directly to the fourth transistor source;

(v) the first transistor source, the second transistor source, the third transistor drain and the fourth transistor drain are electrically coupled together; and (vi) the first transistor gate, the second transistor gate, the third transistor gate and the fourth transistor gate are electrically coupled together;

the first, second, third and fourth transistors configured to control an amount of current flowing through a pixel LED corresponding to a signal applied to gates of the first, second, third and fourth transistors;

the constituent transistors and the first, second, third and fourth transistors distributed on a substrate in a uniform pattern, the constituent transistors and the first, second, third and fourth transistors configured to share a common gate geometry size.

2. A unit pixel driver circuit according to claim 1, wherein the uniform pattern is a set of rows and columns.

3. A unit pixel driver circuit according to claim 1, wherein the transistors are disposed on the substrate such that:

the first transistor is adjacent to the second transistor and the third transistor;

the second transistor is adjacent to the first transistor and the fourth transistor;

the third transistor is adjacent to the first transistor and the fourth transistor; and the fourth transistor is adjacent to the second transistor and the third transistor.

4. A unit pixel driver circuit according to claim 3, further including a capacitor configured to store the voltage, the capacitor being electrically coupled to the gates of the two or more transistors.

5. A unit pixel driver circuit according to claim 4, wherein the capacitor is implemented using one or more transistors.

6. A unit pixel driver circuit according to claim 5, wherein the one or more transistors implementing the capacitor share a common gate geometry size with the two or more transistors connected together in parallel and in series.

7. A unit pixel driver circuit according to claim 1, wherein the signal applied to the gates of the two or more transistors is a voltage.

8. A method of driving a pixel LED, comprising:

providing a capacitor configured to store a voltage corresponding to a desired pixel brightness, the capacitor comprising an interconnected combination of constituent transistors;

applying a control signal, derived from the voltage corresponding to a desired pixel brightness, to a block of:

a first transistor comprising a first transistor gate, a first transistor drain and a first transistor source;

a second transistor comprising a second transistor gate, a second transistor drain and a second transistor source;

a third transistor comprising a third transistor gate, a third transistor drain and a third transistor source;

a fourth transistor comprising a fourth transistor gate, a fourth transistor drain and a fourth transistor source, the block of first, second, third and fourth transistors are configured such that:

(i) the first transistor drain electrically coupled directly to the second transistor drain;

(ii) the first transistor source are electrically coupled directly to a second transistor source;

(iii) the third transistor drain are electrically coupled directly to the fourth transistor drain;

(iv) the third transistor source are electrically coupled directly to the fourth transistor source;

(v) the first transistor source, the second transistor source, the third transistor drain and the fourth transistor drain are electrically coupled directly together and (vi) the first transistor, the second transistor, the third transistor, the fourth transistor and the interconnected combination of constituent transistors configured to share a common gate geometry size; and controlling an amount of current flowing through the pixel LED, the amount of current corresponding to the control signal.

* * * * *